US008938961B2

(12) United States Patent
Leustek et al.

(10) Patent No.: US 8,938,961 B2
(45) Date of Patent: Jan. 27, 2015

(54) EGR FLOW SENSOR FOR AN ENGINE

(75) Inventors: Matthew Edward Leustek, Metamora, IL (US); Justin Werner McMenamy, Chillicothe, IL (US); Jeffrey S. Morris, Bartonville, IL (US); Matthew John Liening, Washington, IL (US); Joseph John Stabnik, Rensselaer, IN (US); William Lyle Schell, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 349 days.

(21) Appl. No.: 13/341,405

(22) Filed: Dec. 30, 2011

(65) Prior Publication Data

US 2013/0167811 A1 Jul. 4, 2013

(51) Int. Cl.
*F02B 33/44* (2006.01)

(52) U.S. Cl.
USPC ..... 60/605.2; 60/611; 701/108; 73/861.63; 73/861.64; 73/861.52

(58) Field of Classification Search
USPC ..... 73/861.63, 861.64, 861.52; 701/108; 60/605.2, 611; 123/568.11, 568.12, 123/568.17
See application file for complete search history.

(56) References Cited

U.S. PATENT DOCUMENTS

| | | | | |
|---|---|---|---|---|
| 4,311,040 | A | 1/1982 | Long | |
| 4,483,195 | A | 11/1984 | Brown et al. | |
| 4,555,952 | A | 12/1985 | Jenkins | |
| 4,620,440 | A | 11/1986 | Thompson | |
| 5,048,327 | A | 9/1991 | Atwood | |
| 5,063,787 | A | 11/1991 | Khuzai et al. | |
| 5,450,753 | A | 9/1995 | Maynor et al. | |
| 5,471,884 | A | 12/1995 | Czarnocki et al. | |
| 5,612,497 | A | 3/1997 | Walter et al. | |
| 6,029,527 | A * | 2/2000 | Seitz et al. | 73/861.52 |
| 6,435,166 | B1 | 8/2002 | Sato et al. | |
| 6,575,022 | B1 | 6/2003 | Schneider et al. | |
| 6,715,367 | B1 | 4/2004 | Gonzales et al. | |
| 6,810,725 | B2 | 11/2004 | Henderson et al. | |
| 6,812,029 | B2 | 11/2004 | Ohsuga et al. | |
| 6,850,833 | B1 | 2/2005 | Wang et al. | |
| 7,237,439 | B1 | 7/2007 | Rutherford et al. | |
| 7,290,528 | B2 | 11/2007 | Minegishi et al. | |
| 7,320,220 | B1 | 1/2008 | Atkinson | |

(Continued)

FOREIGN PATENT DOCUMENTS

| | | | |
|---|---|---|---|
| DE | 102005043778 | A1 | 3/2007 |
| JP | 9158790 | A | 6/1997 |

(Continued)

*Primary Examiner* — Thomas Moulis
*Assistant Examiner* — Joseph Dallo
(74) *Attorney, Agent, or Firm* — Finnegan, Henderson, Farabow, Garrett & Dunner LLP

(57) ABSTRACT

A disclosed method of operating an engine may include discharging exhaust gas from at least one combustion chamber of the engine. The method may also include recirculating at least a portion of the exhaust gas to the at least one combustion chamber through an EGR system, including directing at least a portion of the exhaust gas through an EGR duct. Additionally, the method may include sensing pressure in a portion of the EGR duct by directing the pressure to a first pressure sensor via a first sensor passage having a first end connected to a portion of the EGR duct and a second end connected to the first pressure sensor, while maintaining a temperature of gas in the first sensor passage adjacent the second end at a bulk temperature of at least about 75 percent of a bulk temperature of gas in the first sensor passage at the first end.

19 Claims, 3 Drawing Sheets

(56) References Cited

U.S. PATENT DOCUMENTS

| | | | | |
|---|---|---|---|---|
| 7,921,830 | B2 * | 4/2011 | Schneider et al. | 123/568.17 |
| 8,590,561 | B2 * | 11/2013 | Igarashi | 137/487 |
| 2005/0188965 | A1 * | 9/2005 | Usui | 123/568.12 |
| 2007/0267002 | A1 * | 11/2007 | Schmid et al. | 123/568.17 |
| 2009/0084193 | A1 | 4/2009 | Cerabone et al. | |
| 2010/0077996 | A1 * | 4/2010 | Pantow et al. | 123/557 |
| 2010/0154758 | A1 * | 6/2010 | Schneider et al. | 123/568.12 |
| 2010/0154895 | A1 * | 6/2010 | Igarashi | 137/87.04 |
| 2010/0179745 | A1 * | 7/2010 | Nakayama et al. | 701/108 |
| 2011/0017179 | A1 * | 1/2011 | Ichihara et al. | 123/568.21 |
| 2011/0041622 | A1 * | 2/2011 | Andrew et al. | 73/861.63 |
| 2011/0232614 | A1 | 9/2011 | Emerick et al. | |

FOREIGN PATENT DOCUMENTS

| | | | |
|---|---|---|---|
| JP | 11200913 | A | 7/1999 |
| JP | 2008069690 | A | 3/2008 |
| JP | 2009115508 | | 5/2009 |
| KR | 20080111937 | A | 12/2008 |

* cited by examiner

EGR FLOW SENSOR FOR AN ENGINE

TECHNICAL FIELD

The present disclosure relates to internal combustion engines and, more particularly, to internal combustion engines that employ exhaust gas recirculation.

BACKGROUND

Many machines include an internal combustion engine for producing power. Such internal combustion engines combust fuel in one or more combustion chambers and expel exhaust gas from those one or more combustion chambers. Some internal combustion engines employ exhaust gas recirculation (EGR), where a portion of the expelled exhaust gas is directed back to the one or more combustion chambers for a subsequent combustion cycle. In some cases, it is desirable to sense the rate at which exhaust gas is being recirculated to the combustion chambers.

Published U.S. Patent Application No. 2009/0084193 to Cerabone et al. ("the '193 application") discloses an apparatus for measuring an exhaust gas recirculation flow of an internal combustion engine. The apparatus of the '193 application includes a venturi pipe through which recirculated exhaust gas flows. The apparatus further includes a differential pressure sensor that is in fluid communication with the venturi pipe through passages that connect to the venturi pipe. The '193 application discloses that these devices serve to measure the flow rate of exhaust gas through the venturi pipe.

Although the '193 application discloses an apparatus that purportedly serves to measure an exhaust gas recirculation flow, certain disadvantages may persist. For example, in some applications, it may be possible for particulate matter to collect in the passages that connect the pressure sensor to the venturi pipe. If these passages become plugged with particulate matter, the pressure sensor may no longer have fluid communication with the venturi pipe, and the device may not accurately measure the flow of exhaust gas recirculation.

The systems and methods of the present disclosure may help address the foregoing problems.

SUMMARY

One disclosed embodiment relates to a method of operating an engine. The method may include discharging exhaust gas from at least one combustion chamber of the engine. The method may also include recirculating at least a portion of the exhaust gas to the at least one combustion chamber through an EGR system, including directing at least a portion of the exhaust gas through an EGR duct. Additionally, the method may include sensing pressure in a portion of the EGR duct by directing the pressure to a first pressure sensor via a first sensor passage having a first end connected to a portion of the EGR duct and a second end connected to the first pressure sensor, while maintaining a temperature of gas in the first sensor passage adjacent the second end at a bulk temperature of at least about 75 percent of a bulk temperature of gas in the first sensor passage at the first end.

Another embodiment relates to an engine. The engine may include at least one combustion chamber. The engine may also include an EGR system operable to recirculate at least a portion of exhaust gas discharged from the at least one combustion chamber back to the at least one combustion chamber. The EGR system may include an EGR duct through which at least a portion of the recirculated exhaust gas flows. Additionally, the engine may include a first pressure sensor connected to the EGR duct by a first sensor passage having a first end connected to a portion of the EGR duct and a second end connected to the first pressure sensor. The first sensor passage may have a length such that a temperature of gas in the first sensor passage adjacent the second end is maintained at a bulk temperature of at least about 75 percent of a bulk temperature of gas in the first sensor passage at the first end.

A further embodiment relates to an EGR flow sensor. The EGR flow sensor may include a body having an EGR duct. The EGR flow sensor may also include a first pressure sensor. Additionally, the EGR flow sensor may include a first sensor passage having a first end in fluid communication with the EGR duct and a second end in fluid communication with the first pressure sensor. At least a portion of the first sensor passage may have a cross-sectional area between about 2 and 10 percent of a cross-sectional area of a portion of the EGR duct adjacent the first end of the first sensor passage.

DETAILED DESCRIPTION

Figure 1:
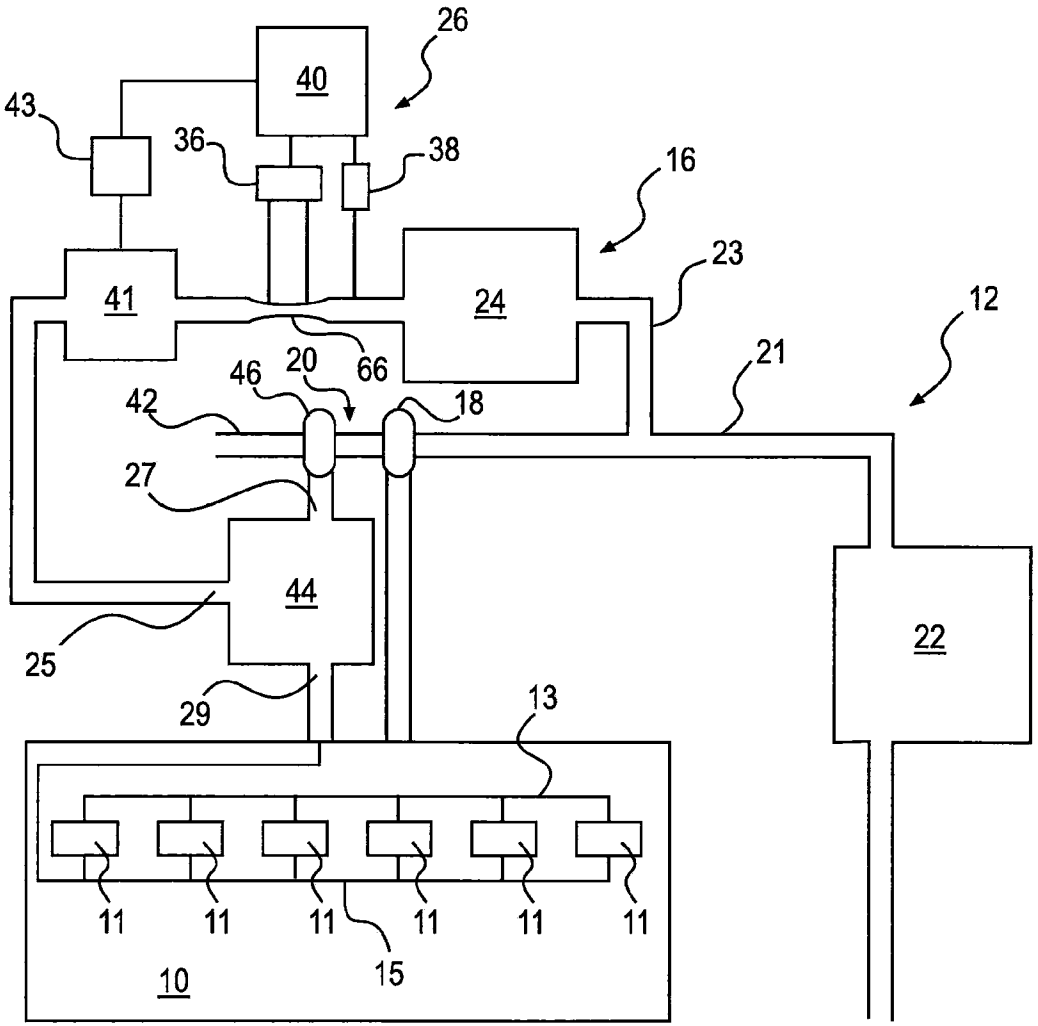
FIG. 1 illustrates one embodiment of an engine with an EGR flow sensor according to the present disclosure.

FIG. 1 illustrates an engine 10 with an exhaust gas recirculation (EGR) system 16 having an EGR flow sensor 26 according to the present disclosure. Engine 10 may be any type of engine configured to produce power by combusting fuel, including, but not limited to, a diesel engine, a gasoline engine, and a gaseous fuel powered engine. Engine 10 may have one or more combustion chambers 11 in which engine 10 combusts fuel. Additionally, engine 10 may include an intake system 14 for delivering air and/or other gases to combustion chambers 11 for combustion with the fuel, as well as an exhaust system 12 for directing exhaust gases resulting from the combustion of the fuel away from combustion chambers 11.

Intake system 14 may include various components for directing air and/or other gases into combustion chambers 11. For example, intake system 14 may include an intake duct 42, a compressor 46 of a turbocharger 20, an EGR mixer 44, and an intake manifold 15 connected to combustion chambers 11. Additionally, intake system 14 may include various other components, including other valves, compressors, filters, passages, heat exchangers, and the like.

Exhaust system 12 may include various components for directing exhaust gases from combustion chambers 11 away from engine 10. For example, exhaust system 12 may include an exhaust manifold 13, a turbine 18 of turbocharger 20, an exhaust duct 21, and an aftertreatment system 22. Aftertreatment system 22 may include various components configured to reduce the amount of undesirable emissions, including, but not limited to, oxides of nitrogen, hydrocarbons, and particulate matter, from the exhaust gas exiting engine 10. In addition to the components shown in FIG. 1, exhaust system 12 may have various other components, including various valves, additional turbines, mufflers, heaters, and the like.

EGR system 16 may include various components configured to direct some of the exhaust gas discharged from combustion chambers 11 back to combustion chambers 11 for subsequent combustion events. EGR system 16 may draw exhaust gas from various places in exhaust system 12. For example, in the embodiment shown in FIG. 1, EGR system 16 may have a duct 23 that draws exhaust gas from exhaust duct 21 between turbine 18 and aftertreatment system 22. Connected to duct 23, EGR system 16 may include an EGR cooler 24, EGR flow sensor 26, an EGR valve 41, and EGR mixer 44. The exhaust gas that EGR system 16 receives from exhaust duct 21 may flow through duct 23, EGR cooler 24, EGR flow sensor 26, and EGR valve 41 to EGR mixer 44. In addition to the components shown in FIG. 1, EGR system 16 may include various other components, including, but not limited to, additional passages, valves, filters, and the like. The components of EGR system 16 may be arranged in different positions relative to one another. For example, EGR flow sensor 26 may be positioned in other places within EGR system 16, including upstream of EGR cooler 24. Similarly, EGR valve 41 may be positioned anywhere upstream of EGR mixer 44, including upstream of EGR flow sensor 26 and/or upstream of EGR cooler 24. Additionally, in some embodiments, EGR valve 41 and EGR mixer 44 may be integrated into one component.

EGR cooler 24 may include any component or components operable to withdraw heat from the exhaust gas recirculated by EGR system 16. For example, in some embodiments, EGR cooler 24 may include a liquid-to-gas heat exchanger that uses the liquid coolant from engine 10 to cool the recirculated exhaust gas.

Figure 2:
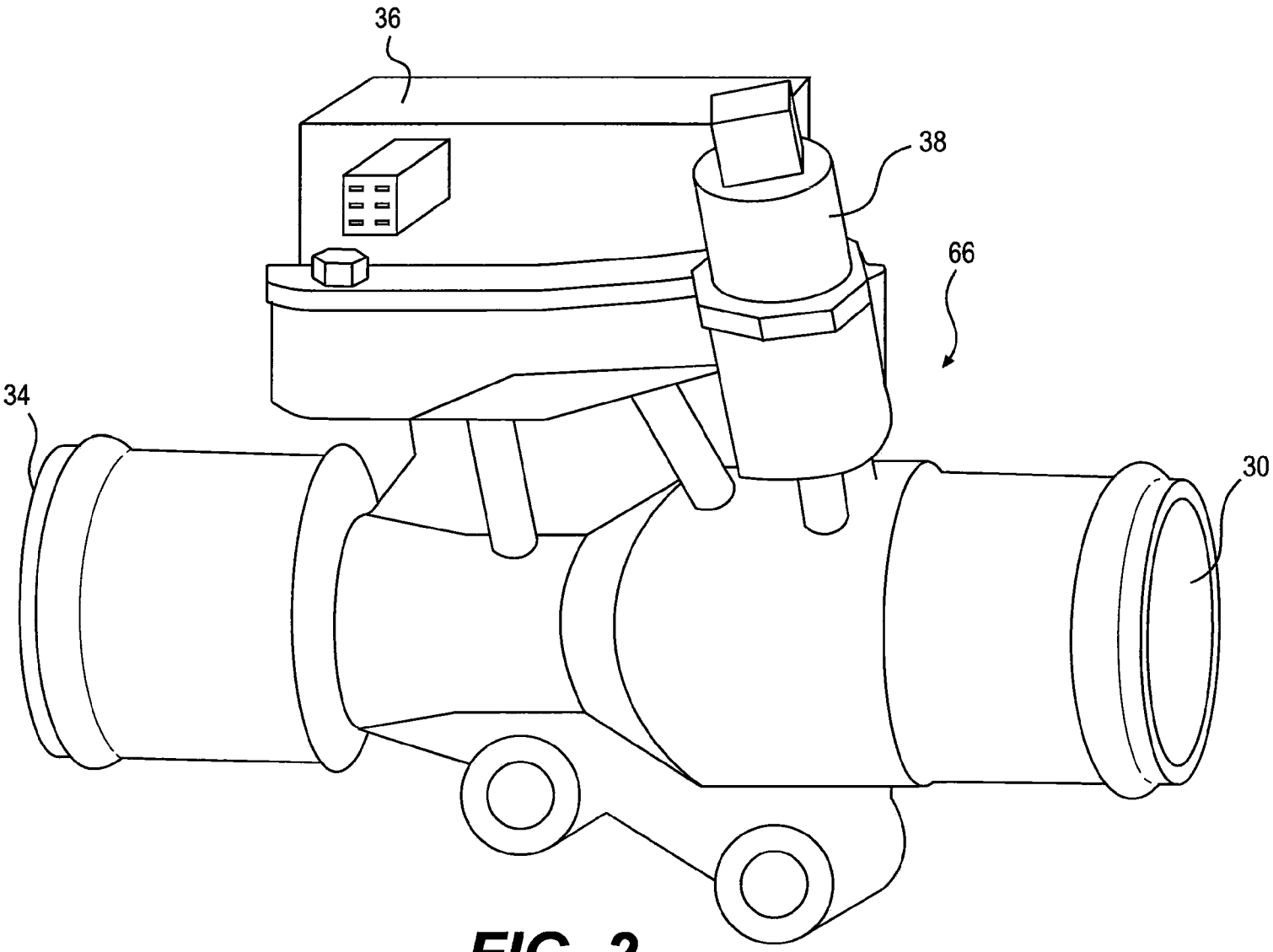
FIG. 2 provides a more detailed view of an EGR flow sensor according to the present disclosure.
Figure 3:
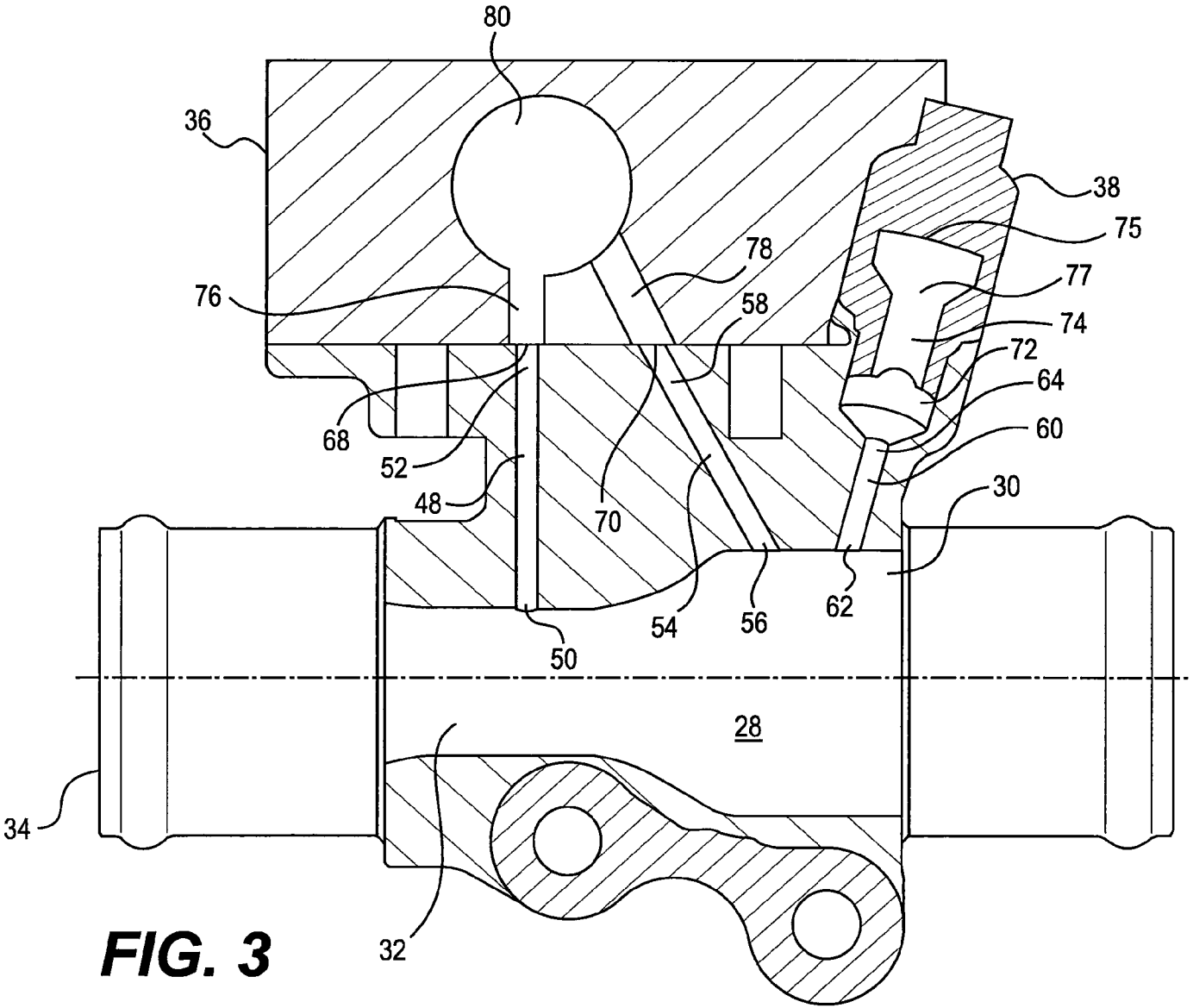
FIG. 3 provides a partially sectional view of the EGR flow sensor shown in FIG. 2.

EGR flow sensor 26 may include a body 66 through which recirculated exhaust gas flows. FIGS. 2 and 3 show body 66 of EGR flow sensor 26 in greater detail. FIG. 2 provides a perspective view of external surfaces of body 66. FIG. 3 provides a side view of body 66 partly in section to show an EGR duct 28 via which the recirculated exhaust gas passes through body 66. EGR duct 28 may include an inlet 30 that receives exhaust gas from EGR cooler 24 and an outlet 34 that discharges exhaust gas to EGR mixer 44.

EGR flow sensor 26 may be a dedicated component for sensing the flow rate of exhaust gas through EGR system 16, or EGR flow sensor 26 may be configured to serve other purposes in addition to sensing flow. As one example of an embodiment where EGR flow sensor 26 is configured to serve multiple purposes, EGR flow sensor 26 may include a valve for controlling flow in EGR system 16, in addition to components for sensing a rate of exhaust gas flow. In the embodiment shown in FIGS. 2 and 3, EGR flow sensor 26 may be a dedicated sensing component. Additionally, in this embodiment, EGR duct 28 may have a venturi configuration with a throat 32 between inlet 30 and outlet 34. Throat 32 may have less cross-sectional area than inlet 30 or outlet 34. Thus, when exhaust gas flows through throat 32 of EGR duct 28, its velocity may increase and its pressure may decrease, as explained by the Bernoulli principle. The various portions of EGR duct 28 may have various cross-sectional shapes. In some embodiments, inlet 30, throat 32, and outlet 34 may have circular cross-sections of different diameters.

Returning to FIG. 1, EGR valve 41 may be configured to control whether and at what rate recirculated exhaust gas flows through EGR system 16. EGR valve 41 may include any component or components operable to provide a variable restriction to exhaust gas flowing through EGR system 16, including, but not limited to, butterfly valves, ball valves, gate valves, poppet valves, and the like.

EGR mixer 44 may sit downstream of EGR valve 41, and EGR mixer 44 may serve to mix exhaust gas from EGR system 16 with intake air from intake system 14 for delivery to combustion chambers 11. Accordingly, EGR mixer 44 may include an EGR inlet 25 that receives the recirculated exhaust gas, an air inlet 27 that receives intake air from compressor 46 of turbocharger 20, and an outlet 29 that discharges air and/or recirculated exhaust gas to intake manifold 15 for delivery to combustion chambers 11.

Engine 10 may have various provisions for controlling EGR valve 41 to meter the admission of recirculated exhaust gas into intake system 14. In some embodiments, engine 10 may include a valve actuator 43 operatively connected to EGR valve 41, and an engine controller 40 operatively connected to valve actuator 43. This may allow engine controller 40 to adjust the rate of exhaust gas recirculation by controlling operation of valve actuator 43. Controller 40, valve actuator 43, and EGR valve 41 may control the rate of exhaust gas recirculation based on various inputs and according to various control schemes to achieve various objectives. Controller 40 may also control other aspects of the operation of engine 10. For example, controller 40 may control the supply of fuel to combustion chambers 11 by controlling various fuel-system components (not shown). Controller 40 may include any component or components operable to control these various aspects of the operation of engine 10. In some embodiments, controller 40 may include one or more microprocessors and one or more memory devices.

Controller 40 may be configured to estimate a rate of exhaust gas flow in EGR system 16 based at least in part on information gathered with EGR flow sensor 26. Controller 40 may estimate the rate of exhaust gas flow in EGR system 16 based on information from EGR flow sensor 26 by itself, or based on information from EGR flow sensor 26 in combination with other information. To estimate the rate of exhaust gas flow in EGR system 16, controller 40 may use theoretical and/or empirical approaches. Similarly, controller 40 may estimate the rate of exhaust gas flow in EGR system 16 using equations, look-up tables, and/or other means. Estimating the rate of exhaust gas flow in EGR system 16 may help controller 40 more precisely control the rate of exhaust gas recirculation by, for example, allowing controller 40 to perform closed-loop control of EGR valve 41 by way of valve actuator 43 to provide a target exhaust gas recirculation rate.

EGR flow sensor 26 may have various provisions for providing information relating to the flow rate of exhaust gas through EGR system 16. In some embodiments, EGR flow sensor 26 may include a differential pressure sensor 36 and an absolute pressure sensor 38 operatively connected to controller 40. Differential pressure sensor 36 may sense a difference between pressure within throat 32 and pressure within inlet 30 of EGR duct 28. Differential pressure sensor 36 may provide to controller 40 a signal indicating the sensed pressure differential between throat 32 and inlet 30 of EGR duct 28. Based on the Bernoulli principle, the difference between the pressure in these two portions of EGR duct 28 will vary as a function of the velocity of exhaust gas in EGR duct 28. Accordingly, the signal from differential pressure sensor 36 may provide some indication of the velocity of exhaust gas flow through EGR duct 28.

Absolute pressure sensor 38 may sense the absolute pressure in some portion of EGR duct 28. For example, absolute pressure sensor 38 may sense the absolute pressure within inlet 30 of EGR duct 28, and absolute pressure sensor 38 may provide a signal indicative of this pressure to controller 40. This information may prove useful in various ways when estimating the exhaust gas flow rate through EGR system 16. For example, the sensed absolute pressure within EGR duct 28 may provide some indication of the mass density of exhaust gas within EGR duct 28.

Controller 40 may use the signals from differential pressure sensor 36 and absolute pressure sensor 38 in various ways to estimate a mass flow rate of exhaust gas through EGR system 16. In some embodiments, controller 40 may calculate a velocity of the exhaust gas flowing through EGR duct 28 based on the signal from differential pressure sensor 36. In some such embodiments, controller 40 may then calculate a mass density of exhaust gas in EGR duct 28 based on the signal from absolute pressure sensor 38 in combination with a sensed temperature of the exhaust gas flowing through EGR duct 28. Controller 40 may then use the estimated velocity and mass density to calculate a mass flow rate of exhaust gas within EGR duct 28 and, thus, EGR system 16.

EGR flow sensor 26 may have various arrangements for exposing differential pressure sensor 36 and absolute pressure sensor 38 to the pressure within EGR duct 28. As shown in FIG. 3, in some embodiments, EGR flow sensor 26 may include a sensor passage 48 and a sensor passage 54 that provide fluid communication from throat 32 and inlet 30 of EGR duct 28 to ports 68 and 70 on body 66. Sensor passage 48 may have a first end 50 that opens into throat 32 of EGR duct 28, and a second end 52 connected to port 68. Similarly, sensor passage 54 may have a first end 56 that opens into inlet 30 of EGR duct 28, and a second end 58 connected to port 70. While FIG. 3 shows an embodiment where the spaces between sensor passages 48, 54, 60 are filled with the parent material of body 66 of EGR flow sensor 26, some embodiments of EGR flow sensor may have voids, or air gaps, between adjacent passages 48, 54, 60.

Differential pressure sensor 36 may be connected to ports 68 and 70 to allow differential pressure sensor 36 to sense the pressure of gas in throat 32 and inlet 30, as communicated through sensor passages 48, 54. Differential pressure sensor 36 may have an internal port 76 connected to port 68. Additionally, differential pressure sensor 36 may have a chamber 80 connected to internal port 76. Thus, chamber 80 may be fluidly connected to throat 32 via sensor passage 48, port 68, and port 76. Connected to port 70, differential pressure sensor 36 may include a port 78. Port 78 may extend to a chamber (not shown) similar to chamber 80. Differential pressure sensor 38 may have provisions for sensing a difference in pressure between chamber 80 and the chamber connected to port 70. For example, differential pressure sensor 36 may include a diaphragm (not shown) between chamber 80 and the chamber connected to port 78, as well as provisions for generating a signal based on deflection of the diaphragm due to differences in pressure between chamber 80 and the chamber on the other side of the diaphragm To expose absolute pressure sensor 38 to pressure within inlet 30 of EGR duct 28, EGR flow sensor 26 may include a sensor passage 60 that provides fluid communication from inlet 30 to a port 72. Sensor passage 60 may include a first end 62 opening into inlet 30 of EGR duct 28, as well as a second end 64 connected to port 72. Absolute pressure sensor 38 may connect to port 72 to sense pressure within inlet 30, as communicated through sensor passage 60. For example, absolute pressure sensor 38 may include a port 74 in fluid communication with port 72. Port 74 may extend to an internal chamber 77 of absolute pressure sensor 38. Absolute pressure sensor 38 may have provisions for sensing pressure in chamber 77 as an indication of pressure within inlet 30 of EGR duct 28. For example, absolute pressure sensor 38 may include a diaphragm 75 at an internal end of chamber 77, and absolute pressure sensor 38 may have provisions for generating a signal based on deflection of diaphragm 75 due to pressure within chamber 77.

Sensor passages 48, 54, and 60 may have various geometries. In some embodiments, one or more of sensor passages 48, 54, 60 may have a circular cross-section. Additionally, one or more of sensor passages 48, 54, 60 may have a relatively small cross-sectional area. For example, sensor passage 54 may have a cross-sectional area of between about 2 and 10 percent of the cross-sectional area of the inlet 30 adjacent first end 56 of passage 54. The specific cross-sectional area of sensor passage 54 may have a variety of values. In some embodiments, sensor passage 54 may have a cross-sectional area between about 10 $mm^2$ and 50 $mm^2$, or between about 20 $mm^2$ and 40 $mm^2$. In one example, where passage 54 has a circular cross-section and inlet 30 also has a circular cross-section, passage 54 may have a diameter of 6 mm, and inlet 30 may have a diameter of 35 mm. In this example, passage 54 may have a cross-sectional area of 28.27 $mm^2$ and inlet 30 may have a cross-sectional area of 962.11 $mm^2$, such that passage 54 has a cross-sectional area of 2.94 percent of the cross-sectional area of inlet 30 adjacent first end 56 of passage 54.

In some embodiments, one or both of passages 48 and 60 may have cross-sectional dimensions similar to those discussed above for passage 54. Thus, passage 48 may have a cross-sectional area between about 2 and 10 percent of the cross-sectional area of throat 32 adjacent first end 50 of passage 48. Similarly, passage 60 may have a cross-sectional area between about 2 and 10 percent of the cross-sectional area of inlet 30 adjacent first end 62 of passage 60. In one example, passage 48 and passage 60 may each have a circular cross-section with a diameter of 6 mm, throat 32 may have a circular cross-section with a diameter of 19.5 mm, and inlet 30 may have a circular cross-section with a diameter of 35 mm. In some embodiments, substantially the entire length of each of sensor passages 48, 54, 60 may have a cross-sectional area of greater than about 2 percent of the adjacent portion of EGR duct 28.

Passages 48, 54, 60 may have various lengths. The length of each passage 48, 54, 60 may affect the temperature of the exhaust gas adjacent the second end 52, 58, 64 of the passage. At the first end 50, 56, 62 of each passage 48, 54, 60, the exhaust gas may retain a relatively high temperature from the combustion process. At some distance from the first end 50, 56, 62 of each passage 48, 54, 60, the temperature may tend to decrease because of heat transfer to the surrounding environment. Thus, the longer each passage 48, 54, 60 is, the more difference there may be between the temperatures at the first ends 50, 56, 62 and second ends 52, 58, 64 of the passage 48, 54, 60. In some embodiments, passages 48, 54, 60 may have relatively short lengths that result in relatively little difference between the temperatures at the first ends 50, 56, 62 and second ends 52, 58, 64. For example, in some embodiments, one or all of passages 48, 54, 60 may have a length such that the bulk gas temperature at the second end 52, 58, 64 of the passage 48, 54, 60 is at least about 75 percent of the bulk gas temperature at the first end 50, 56, 62 of the passage 48, 54, 60. Furthermore, in some embodiments, one or all of passages 48, 54, 60 may have a length such that the bulk gas temperature at the second end 52, 58, 64 of the passage 48, 54, 60 is higher yet, such as at least about 90 percent of, or even approximately the same as, the bulk gas temperature at the first end 50, 56, 62 of the passage 48, 54, 60. As an example, each of passages 48, 54, 60 may be less than about 100 mm or less than about 75 mm long. For instance, passage 48 may be approximately 60 mm long between first and second ends 50, 52, passage 54 may be approximately 50 mm long between first and second ends 56, 58, and passage 60 may be approximately 24 mm long between first and second ends 62, 64.

At the same time, EGR flow sensor 26 may be configured in a manner to help keep the exhaust gas in the internal chambers of differential pressure sensor 36 and absolute pressure sensor 38 at temperatures that will not cause thermal damage to the sensors. For example, passage 48 and internal port 76 of differential pressure sensor 36 may have lengths sufficient to ensure that exhaust gas in chamber 80 of differential pressure sensor 36 generally remains below 125° Celsius. Similarly, passage 54 and internal port 78 of differential pressure sensor 36 may have lengths sufficient to ensure that exhaust gas in the chamber connected to internal port 78 generally remains below 125° Celsius. Likewise, passage 60, port 72, and port 74 of absolute pressure sensor 38 may have lengths sufficient to ensure that exhaust gas within internal port 77 of absolute pressure sensor 38 generally remains below 125° Celsius. Of course, in embodiments where differential pressure sensor 36 and/or absolute pressure sensor 38 have the ability to withstand temperatures greater than 125° Celsius, the temperature of gas in sensor passages 48, 54, and 60 may be allowed to go to higher temperatures.

EGR flow sensor 26 may have various other provisions for protecting differential pressure sensor 36 and absolute pressure sensor 38 from thermal damage. In some embodiments, body 66 of EGR flow sensor 26 may be constructed of material with relatively low thermal conductivity, such as ferrous metal or plastic. Additionally, EGR flow sensor 26 may include components that act as thermal barriers between body 66 of EGR flow sensor 26 and differential pressure sensor 36 and absolute pressure sensor 38. For example, EGR flow sensor 26 may include gaskets (not shown) with low thermal conductivity between body 66 of EGR flow sensor 26 and one or both of differential pressure sensor 36 and absolute pressure sensor 38. Similarly, EGR flow sensor 26 may include air gaps between body 66 and one or both of differential pressure sensor 36 and absolute pressure sensor 38. All of these provisions may inhibit transmission of heat from body 66 to differential pressure sensor 36 and absolute pressure sensor 38.

Passages 48, 54, 60 may have various shapes. In some embodiments, passages 48, 54, 60 may each extend in a substantially straight line between their first ends 50, 56, 62 and their second ends 52, 58, 64. Additionally, in some embodiments, passages 48, 54, 60 may have substantially constant cross-sectional shapes and sizes between their first ends 50, 56, 62 and their second ends 52, 58, 64. Furthermore, in some embodiments, there may be no openings or interconnections in the walls of passages 48, 54, 60 between their first ends 50, 56, 62 and their second ends 52, 58, 64.

Engine 10, EGR system 16, and EGR flow sensor 26 may have different configurations than the examples discussed above and shown in FIGS. 1-3. For instance, while FIG. 3 shows sensor passages 48, 54, 60 having substantially the same cross-sectional size as one another and substantially the same shape (i.e., straight) as one another, one or more of sensor passages 48, 54, 60 may have different sizes and/or shapes than the others. Additionally, one or more portions of EGR duct 28 may have a cross-sectional shape other than circular. Furthermore, EGR system 16 may draw exhaust gas from a different portion of exhaust system 12, such as from upstream of turbine 18 or downstream of aftertreatment system 22.

Additionally, EGR flow sensor 26 may not have a venturi configuration in EGR duct 28. Any configuration of EGR flow sensor 26 that will provide some pressure drop within duct 28 as exhaust gas flows through it may allow sensing the flow rate of exhaust gas through EGR system 16. For example, in lieu of a venturi, EGR flow sensor 26 may rely on a valve or other obstruction in EGR duct 28 to create a pressure differential that differential pressure sensor 36 can sense as an indication of the flow rate in EGR duct 28. Similarly, EGR flow sensor 26 may simply have a long enough EGR duct 28 to create a measurable pressure differential between two points therein. Furthermore, controller 40 may be configured to estimate the flow rate of exhaust gas within EGR system 16 based on information from EGR flow sensor 26 in different ways than discussed above.

Industrial Applicability

The disclosed engine 10 may have use in any application requiring power to perform one or more tasks, and the disclosed EGR flow sensor 26 may have use with any engine that employees exhaust gas recirculation. The disclosed configurations of EGR flow sensor 26 may promote reliable operation of EGR flow sensor 26 by inhibiting plugging of passages 48, 54, 60. Various of the foregoing aspects of the design of EGR flow sensor 26 may contribute to this beneficial result.

For example, giving passages 48, 54, 60 relatively small cross-sectional areas, such as less than about 10 percent of the cross-sectional area of the adjoining portion of EGR duct 28, may tend to inhibit plugging of the passages. Because engine 10 typically releases exhaust gases into exhaust system 12 in pulses, the pressure of the gases in exhaust system 12 and EGR system 16 tends to pulse. The pressure pulses in EGR duct 28 of EGR flow sensor 26 may tend to drive gas and particulate matter into passages 48, 54, 60. Giving passages 48, 54, 60 relatively small cross-sectional areas may tend to restrict the transmission of larger pressure pulses into passages 48, 54, 60, thereby inhibiting the flow of particulate matter into passages 48, 54, 60. Inhibiting the flow of particulate matter into passages 48, 54, 60 may reduce the likelihood of particulate matter plugging the passages.

At the same time, ensuring that passages 48, 54, 60 do not have too small a cross-sectional area may also tend to inhibit plugging of the passages. For example, giving each of passages 48, 54, 60 a cross-sectional area of at least about 2 percent of the corresponding section of EGR duct 28 may inhibit plugging by reducing the possibility of a very small amount of particulate matter plugging the passages. Making sure passages 48, 54, 60 are not too small may also allow fluids that condense in passages 48, 54, 60 to drain from passages 48, 54, 60 without bridging the walls of the passages 48, 54, 60 due to surface tension of the liquid.

Additionally, providing passages 48, 54, 60 with smooth, straight, uninterrupted walls may reduce the likelihood of plugging. Reducing the number of obstructions that particulate matter in passages 48, 54, 60 may encounter also tends to reduce the likelihood of particulate lodging in passages 48, 54, 60.

Giving passages 48, 54, 60 a length to suppress temperature drop over the length of the passages may also inhibit plugging. Keeping the temperature of the gas in the second ends 52, 58, 64 of passages 48, 54, 60 close to the temperature of the gas in EGR duct 28 may help prevent particulate matter that does enter passages 48, 54, 60 from collecting on the walls of the passages due to thermophoresis and condensation of hydrocarbons in the gas.

At the same time, maintaining the temperature of the gas in the internal passages and chambers of differential pressure sensor 36 and absolute pressure sensor 38 from getting too high may also provide certain benefits. For example, maintaining the temperature of the gas in the internal chambers of differential pressure sensor 36 and absolute pressure sensor 38 below certain levels may help prevent thermal damage to differential pressure sensor 36 and absolute pressure sensor 38.

Inhibiting plugging of passages 48, 54, 60 and damage to differential pressure sensor 36 and absolute pressure sensor 38 may help ensure that controller 40 receives accurate information regarding the pressures in EGR duct 28. This may help controller 40 accurately ascertain and control the rate of exhaust gas recirculation through EGR system 16, which may promote effective, efficient operation of engine 10.

It will be apparent to those skilled in the art that various modifications and variations can be made in the disclosed systems and methods without departing from the scope of the disclosure. Other embodiments of the disclosed systems and methods will be apparent to those skilled in the art from consideration of the specification and practice of the systems and methods disclosed herein. It is intended that the specification and examples be considered as exemplary only, with a true scope of the disclosure being indicated by the following claims and their equivalents.

What is claimed is:

1. A method of operating an engine, the method comprising:

discharging exhaust gas from at least one combustion chamber of the engine;

recirculating at least a portion of the exhaust gas to the at least one combustion chamber through an EGR system, including directing at least a portion of the exhaust gas through an EGR duct;

sensing pressure in a portion of the EGR duct by directing the pressure to a first pressure sensor via a first sensor passage having a first end connected to a portion of the EGR duct and a second end connected to the first pressure sensor, while maintaining a temperature of gas in the first sensor passage adjacent the second end at a bulk temperature of at least about 75 percent of a bulk temperature of gas in the first sensor passage at the first end.

2. The method of claim 1, wherein maintaining the bulk temperature of gas in the first sensor passage at the second end at a temperature of at least about 75 percent of the bulk temperature of gas in the first sensor passage at the first end includes maintaining the bulk temperature of the gas at the second end at a temperature of at least about 90 percent of the bulk temperature of gas in the first sensor passage at the first end.

3. The method of claim 1, wherein the first sensor passage has a length of less than about 100 mm.

4. The method of claim 1, wherein:

the EGR duct includes an inlet, an outlet, and a throat between the inlet and the outlet, the throat having a smaller cross-sectional area than the inlet and the outlet;

the first end of the first sensor passage is connected to the throat of the EGR duct;

the first pressure sensor is a differential pressure sensor; and sensing pressure further comprises directing pressure to the first pressure sensor via a second sensor passage having a first end connected to the inlet of the EGR duct and a second end connected to the first pressure sensor, while maintaining a temperature of gas in the second sensor passage adjacent its second end at a bulk temperature of at least about 75 percent of a bulk temperature of gas in the second sensor passage at its first end.

5. The method of claim 4, further comprising directing pressure to a second pressure sensor via a third sensor passage having a first end connected to the inlet of the EGR duct and a second end connected to the second pressure sensor, while maintaining a temperature of gas in the third sensor passage adjacent its second end at a bulk temperature of at least about 75 percent of a bulk temperature of gas in the third sensor passage at its first end.

6. An engine, comprising:

at least one combustion chamber;

an EGR system operable to recirculate at least a portion of exhaust gas discharged from the at least one combustion chamber back to the at least one combustion chamber, the EGR system including an EGR duct through which at least a portion of the recirculated exhaust gas flows;

a first pressure sensor connected to the EGR duct by a first sensor passage having a first end connected to a portion of the EGR duct and a second end connected to the first pressure sensor, the first sensor passage having a length such that a temperature of gas in the first sensor passage adjacent the second end is maintained at a bulk temperature of at least about 75 percent of a bulk temperature of gas in the first sensor passage at the first end.

7. The engine of claim 6, wherein the first sensor passage has a length such that the bulk gas temperature adjacent the second end of the first sensor passage is maintained at least about 90 percent of a bulk gas temperature at the first end of first the sensor passage.

8. The engine of claim 6, wherein the first sensor passage has a length of less than about 100 mm.

9. The engine of claim 6, wherein:

the EGR duct includes an inlet, an outlet, and a throat between the inlet and the outlet, the throat having a smaller cross-sectional area than the inlet and the outlet;

the first end of the first sensor passage is connected to the throat of the EGR duct;

the first pressure sensor is a differential pressure sensor; and the first pressure sensor is further connected to the EGR duct via a second sensor passage having a first end connected to the inlet of the EGR duct and a second end connected to the first pressure sensor, the second sensor passage having a length such that a temperature of gas in the second sensor passage adjacent its second end is maintained at a bulk temperature of at least about 75 percent of a bulk temperature of gas in the second sensor passage at its first end.

10. The engine of claim 9, further comprising:

a second pressure sensor; and a third sensor passage having a first end connected to the inlet of the EGR duct and a second end connected to the second pressure sensor, the third sensor passage having a length such that a temperature of gas in the third sensor passage adjacent its second end is maintained at a bulk temperature of at least about 75 percent of a bulk temperature of gas in the third sensor passage at its first end.

11. An EGR flow sensor, comprising:

a body having an EGR duct;

a first pressure sensor; and a first sensor passage having a first end in fluid communication with the EGR duct and a second end in fluid communication with the first pressure sensor, wherein at least a portion of the first sensor passage has a cross-sectional area between about 2 and 10 percent of a cross-sectional area of a portion of the EGR duct adjacent the first end of the first sensor passage such that a temperature of gas in the first sensor passage adjacent the second end is maintained at a bulk temperature of at least about 75 percent of a bulk temperature of gas in the first sensor passage at the first end.

12. The EGR flow sensor of claim 11, wherein at least a portion of the first sensor passage has a cross-sectional area of between about 10 $mm^2$ and about 50 $mm^2$.

13. The EGR flow sensor of claim 11, wherein at least a portion of the first sensor passage has a cross-sectional area between about 20 $mm^2$ and about 40 $mm^2$.

14. The EGR flow sensor of claim 11, wherein the first sensor passage is substantially straight.

15. The EGR flow sensor of claim 11, wherein the first sensor passage is smooth, straight, and substantially free of obstructions.

16. The EGR flow sensor of claim 11, wherein the first sensor passage has a length of less than about 100 mm.

17. The EGR flow sensor of claim 11, wherein:

the EGR duct includes an inlet, an outlet, and a throat between the inlet and the outlet, the throat having a smaller cross-sectional area than the inlet and the outlet; and the first end of the first sensor passage connects to the throat of the EGR duct.

18. The EGR flow sensor of claim 17, wherein:

the first pressure sensor is a differential pressure sensor; and the EGR flow sensor further comprises a second sensor passage having a first end in fluid communication with the inlet of the EGR duct and a second end in fluid communication with the first pressure sensor.

19. The EGR flow sensor of claim 18, further comprising:

a second pressure sensor;

a third sensor passage having a first end in fluid communication with the EGR duct and a second end in fluid communication with the second pressure sensor, wherein at least a portion of the third sensor passage has a cross-sectional area between about 2 and 10 percent of a cross-sectional area of a portion of the EGR duct adjacent the first end of the third sensor passage.

* * * * *